US011786933B2

(12) United States Patent
Hashimoto et al.

(10) Patent No.: US 11,786,933 B2
(45) Date of Patent: Oct. 17, 2023

(54) VIBRATION SIGNAL GENERATION APPARATUS AND COMPUTER-READABLE, NON-TRANSITORY STORAGE MEDIUM STORING VIBRATION SIGNAL GENERATION PROGRAM

(71) Applicant: CLARION CO., LTD., Saitama (JP)

(72) Inventors: Takeshi Hashimoto, Motomiya (JP); Yasuhiro Fujita, Kashiwa (JP)

(73) Assignee: CLARION CO., LTD., Saitama (JP)

( * ) Notice: Subject to any disclaimer, the term of this patent is extended or adjusted under 35 U.S.C. 154(b) by 777 days.

(21) Appl. No.: 16/919,037

(22) Filed: Jul. 1, 2020

(65) Prior Publication Data

US 2021/0031233 A1 Feb. 4, 2021

(30) Foreign Application Priority Data

Jul. 29, 2019 (JP) ..... 2019-138744

(51) Int. Cl.
*B06B 1/02* (2006.01)
*H04R 1/02* (2006.01)
*H04R 5/02* (2006.01)

(52) U.S. Cl.
CPC ..... *B06B 1/0238* (2013.01); *H04R 1/025* (2013.01); *H04R 5/023* (2013.01); *B06B 2201/70* (2013.01); *H04R 2201/028* (2013.01)

(58) Field of Classification Search
CPC ... B06B 1/0238; B06B 2201/70; H04R 1/025; H04R 5/023; H04R 2201/028
See application file for complete search history.

(56) References Cited

U.S. PATENT DOCUMENTS 5,684,722 A * 11/1997 Thorner ..... G06F 3/011 703/3
9,128,523 B2 * 9/2015 Buuck ..... G06F 3/016
(Continued)

FOREIGN PATENT DOCUMENTS

EP 3107307 12/2016
JP 60-144377 U 9/1985
(Continued)

OTHER PUBLICATIONS

Extended European Search Report for corresponding EP Application No. 20185055.9-1210, dated Dec. 14, 2020.
(Continued)

*Primary Examiner* — Jason R Kurr
(74) *Attorney, Agent, or Firm* — MORI & WARD, LLP

(57) ABSTRACT

A vibration signal generation apparatus includes an absolute value signal generator configured to generate an absolute value signal by detecting an absolute value of amplitude of an acoustic signal, an envelope signal generator configured to generate an envelope signal by detecting an envelope of the absolute value signal, a differentiator configured to differentiate the envelope signal, an amplitude limiter configured to generate an amplitude-limited signal by limiting amplitude of the envelope signal so that an amplitude value of the differentiated envelope signal becomes zero or greater, and a vibration signal generator configured to generate a vibration signal by multiplying the amplitude-limited signal by a reference signal having a frequency that allows a human to perceive a vibration.

8 Claims, 9 Drawing Sheets

(56) References Cited

U.S. PATENT DOCUMENTS

| | | | | |
|---|---|---|---|---|
| 9,866,960 | B2 * | 1/2018 | Hashimoto | H04R 1/025 |
| 11,265,651 | B2 * | 3/2022 | Hashimoto | H04R 3/00 |
| 2005/0036636 | A1 * | 2/2005 | Noro | B06B 1/0215 381/124 |
| 2008/0240484 | A1 * | 10/2008 | Tanghe | H04R 3/04 381/370 |
| 2016/0012687 | A1 * | 1/2016 | Obana | A63F 13/285 340/407.1 |
| 2019/0286235 | A1 * | 9/2019 | Gautama | G06F 3/016 |
| 2020/0211337 | A1 * | 7/2020 | Grant | G08B 25/10 |

FOREIGN PATENT DOCUMENTS

| | | |
|---|---|---|
| JP | 01-208099 | 8/1989 |
| JP | 2009-094561 | 4/2009 |
| JP | 2015-201671 | 11/2015 |
| WO | WO 2006/082553 | 8/2006 |
| WO | WO 2009/103357 | 8/2009 |

OTHER PUBLICATIONS

Japanese Office Action for corresponding JP Application No. 2019-138744, dated Mar. 7, 2023 (w/ machine translation).

* cited by examiner

VIBRATION SIGNAL GENERATION APPARATUS AND COMPUTER-READABLE, NON-TRANSITORY STORAGE MEDIUM STORING VIBRATION SIGNAL GENERATION PROGRAM

CROSS-REFERENCE TO RELATED APPLICATIONS

The present application claims priority to Japanese Patent Application JP 2019-138744 filed in the Japan Patent Office on Jul. 29, 2019, the entire content of which is hereby incorporated by reference.

BACKGROUND OF THE INVENTION

Field of the Invention

The present invention relates to a vibration signal generation apparatus and a computer-readable, non-transitory storage medium storing a vibration signal generation program.

Description of the Related Art

There have been proposed methods of making a predetermined notification or providing a realistic sound environment by causing the user to perceive a vibration generated by a vibration output device. For example, Japanese Unexamined Patent Application Publication No. 2015-201671 discloses seat audio systems in which a full-range speaker is installed near the headrest of the seat and a subwoofer is installed in the backrest or seating portion of the seat.

A full-range speaker is able to output a sound in a low-to-high wide band on the basis of an input signal (acoustic signal), and the sound outputted from the full-range speaker is able to stimulate the auditory sense of the user.

A subwoofer is able to output one or both of a low-band sound and a vibration on the basis of an input signal, and the sound and/or vibration outputted from the subwoofer are able to stimulate the auditory sense and/or the tactile sense of the user.

Examples of a speaker installed in the seat include dynamic speakers using cone paper or the like, as well as linear resonant actuators, such as exciters, which vibrate the contact surface. If a linear resonant actuator is used, the single output unit is able to output both a sound and a vibration.

If the subwoofer outputs both a sound and a vibration, the user is able to perceive the sound through the auditory sense and the vibration through the tactile sense. The frequency range in which humans are able to perceive vibrations through the tactile sense is characterized in that it is narrower than that in which humans are able to perceive sounds through the auditory sense. Humans perceive vibrations through the Meissner's corpuscles, which are a type of tactile receptors in the skin or the like. The frequency range of vibrations perceivable by the Meissner's corpuscles is about 10 to about 150 Hz, and humans are not able to perceive vibrations in a higher frequency range than this frequency range.

The frequency range in which humans are able to perceive sounds is said to be about 20 Hz to about 20 kHz and tends to be higher than that in which humans are able to perceive vibrations (about 10 to about 150 Hz). For example, the frequency range of sounds of pianos is about 30 Hz to about 4 kHz. For this reason, if mid- and high-band sounds of 150 Hz or more of a piano are played back through the subwoofer, the user is not able to perceive the piano sounds as vibrations.

As seen above, whether the user is able to perceive vibrations depends on frequency characteristics of a signal inputted to the vibration output device (subwoofer, etc.).

An object of the present invention is to provide a vibration signal generation apparatus and a computer-readable, non-transitory storage medium storing a vibration signal generation program that are able to generate vibration signals that allow vibrations to be outputted regardless of frequency characteristics of acoustic signals.

SUMMARY OF THE INVENTION

A vibration signal generation apparatus according to one aspect of the present invention includes an absolute value signal generator configured to generate an absolute value signal by detecting an absolute value of amplitude of an acoustic signal, an envelope signal generator configured to generate an envelope signal by detecting an envelope of the absolute value signal generated by the absolute value signal generator, a differentiator configured to differentiate the envelope signal generated by the envelope signal generator, an amplitude limiter configured to generate an amplitude-limited signal by limiting amplitude of the envelope signal differentiated by the differentiator so that an amplitude value of the differentiated envelope signal becomes zero or greater, and a vibration signal generator configured to generate a vibration signal by multiplying the amplitude-limited signal generated by the amplitude limiter by a reference signal having a frequency that allows a human to perceive a vibration.

A computer-readable, non-transitory storage medium storing a vibration signal generation program according to another aspect of the present invention is a computer-readable, non-transitory storage medium storing a vibration signal generation program executed by a vibration signal generation apparatus that generates a vibration signal for outputting a vibration from a vibration output device. The vibration signal generation program causes a controller to perform an absolute value signal generation process of generating an absolute value signal by detecting an absolute value of amplitude of an acoustic signal, an envelope signal generation process of generating an envelope signal by detecting an envelope of the absolute value signal generated in the absolute value signal generation process, a differentiation process of differentiating the envelope signal generated in the envelope signal generation process, an amplitude limiting process of generating an amplitude-limited signal by limiting amplitude of the differentiated envelope signal so that an amplitude value of the differentiated envelope signal becomes zero or greater, and a vibration signal generation process of generating a vibration signal by multiplying the amplitude-limited signal generated in the amplitude limiting process by a reference signal having a frequency that allows a human to perceive a vibration.

In a vibration signal generation apparatus and a computer-readable, non-transitory storage medium storing a vibration signal generation program according to an embodiment of the present invention, the vibration signal generated by multiplying the amplitude-limited signal obtained by the reference signal having the frequency that allows humans to perceive a vibration is a signal having a frequency that allows humans to perceive a vibration. For this reason, when the vibration output unit outputs a vibration using the generated vibration signal, the user is able to perceive changes in the amplitude of the acoustic signal as a vibration.

The amplitude of the vibration signal is increased when the amplitude of the envelope signal is greatly increased, that is, when the amplitude of the acoustic signal is greatly increased. Also, the amplitude of the vibration signal becomes zero when the amplitude of the envelope signal is not changed or is reduced, that is, when the amplitude of the acoustic signal is not changed or is reduced. For this reason, the vibration is further increased and accentuated at the moment when the amplitude of the acoustic signal is greatly changed. Also, the vibration is reduced when the amplitude of the acoustic signal is not greatly changed, and thus is prevented from continuously being generated.

Even if the acoustic signal has amplitude characteristics in which the amplitude value of the acoustic signal is uniform, the vibration is increased and accentuated at the moment when the amplitude of the acoustic signal is greatly changed.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings.

DESCRIPTION OF THE EMBODIMENT

Figure 1:
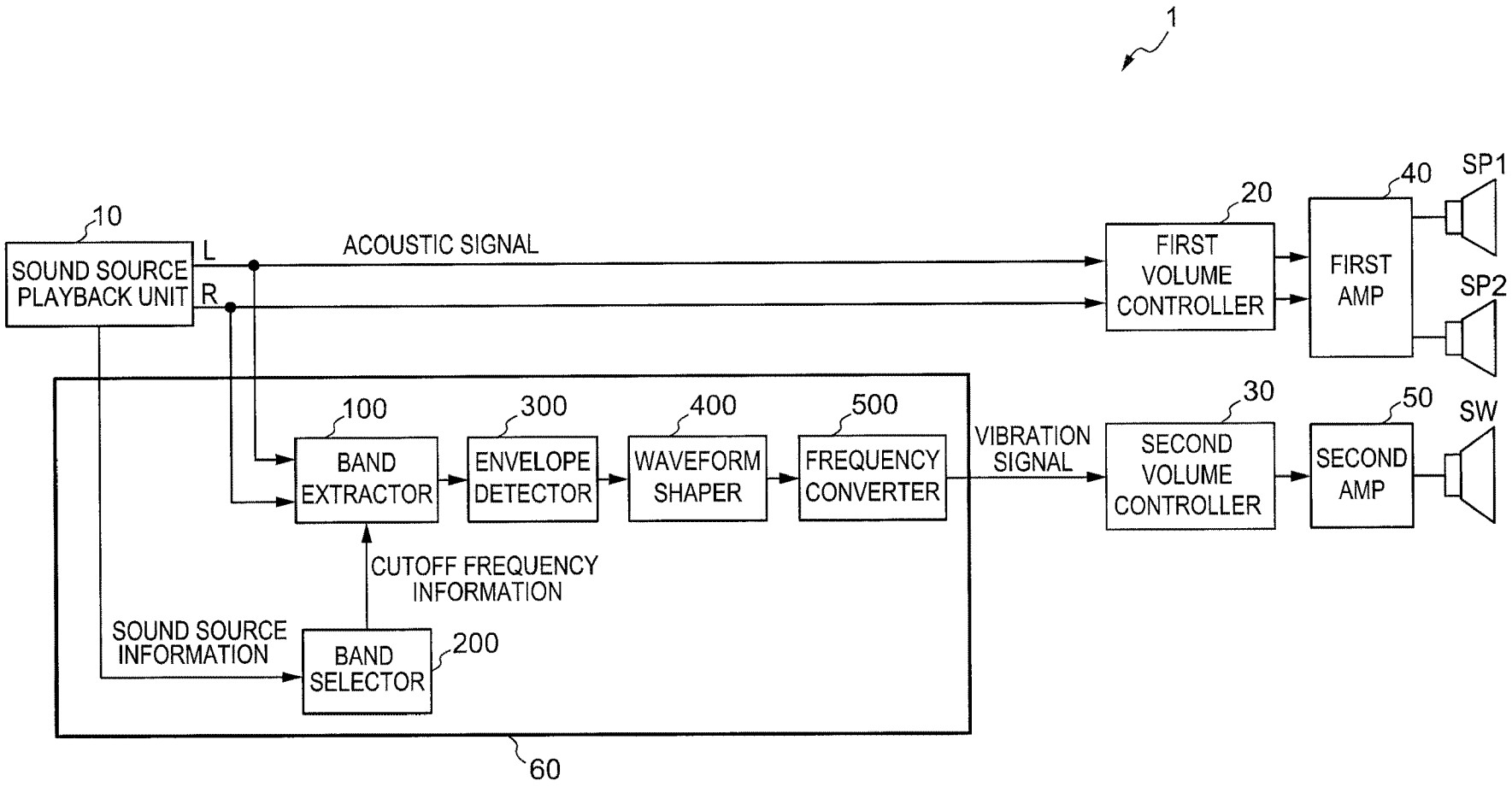
FIG. 1 is a block diagram showing a schematic configuration of a vibration output apparatus according to an embodiment.

Now, a vibration output apparatus including a vibration signal generation apparatus according to an embodiment of the present invention will be described in detail with reference to the drawings. FIG. 1 is a block diagram showing a schematic configuration of the vibration output apparatus.

[Vibration Output Apparatus]

As shown in FIG. 1, a vibration output apparatus 1 includes a sound source playback unit 10, a first volume controller 20, a second volume controller 30, a first amplifier 40, a second amplifier 50, a vibration signal generation apparatus 60, full-range speakers SP1 and SP2, and a subwoofer (vibration output unit) SW.

Acoustic signals played back by the sound source playback unit 10 are outputted from the full-range speakers SP1 and SP2 as sounds that the user is able to perceive through the auditory sense. The acoustic signals played back by the sound source playback unit 10 are also converted into a vibration signal for vibration output by the vibration signal generation apparatus 60 and then outputted from the subwoofer SW as a vibration that the user is able to perceive through the tactile sense. The subwoofer SW is able to output not only a vibration but also a low-band sound in accordance with frequency characteristics of the vibration signal.

[Sound Source Playback Unit]

The sound source playback unit 10 is a unit that outputs acoustic signals in the vibration output apparatus 1. The sound source playback unit 10 is, for example, a CD player, DVD player, or the like, which outputs acoustic signals stored in a storage medium, such as a compact disc (CD) or a digital versatile disc (DVD).

The sound source playback unit 10 outputs acoustic signals to the first volume controller 20 and vibration signal generation apparatus 60. The acoustic signals outputted from the sound source playback unit 10 consist of signals for two channels, that is, an acoustic signal for the right channel and an acoustic signal for the left channel and are finally outputted to the full-range speakers SP1 and SP2 and subwoofer SW.

[First Volume Controller and Second Volume Controller]

The first volume controller 20 is a unit that controls the level of the acoustic signals outputted from the sound source playback unit 10. The second volume controller 30 is a unit that controls the level (vibration level) of the vibration signal generated by the vibration signal generation apparatus 60. The first volume controller 20 and second volume controller 30 are, for example, typical control mechanisms for controlling the volume. By controlling the volume using the first volume controller 20, the user is able to control the volume of sounds outputted from the full-range speakers SP1 and SP2. Also, by controlling the volume (signal level, vibration level) using the second volume controller 30, the user is able to control the volume of sounds or the level of vibrations outputted from the subwoofer SW.

[Full-Range Speakers and Subwoofer]

The full-range speakers SP1 and SP2 and subwoofer SW are installed in the seat. The full-range speakers SP1 and SP2 are speakers that output mid- and high-band sounds and are installed, for example, adjacent to the headrest of the seat so as to be horizontally symmetrical. The subwoofer SW is a speaker that outputs low-band sounds and vibrations and is installed, for example, inside the seating portion of the seat. In the present embodiment, a case will be described in which the subwoofer SW outputs both low-band sounds and vibrations. However, the subwoofer SW only has to be capable of outputting at least vibrations and does not necessarily have to output both vibrations and low-band sounds. As will be described later, the subwoofer SW outputs vibrations and low-band sounds on the basis of vibration signals generated by the vibration signal generation apparatus 60. For this reason, the basic configuration of the subwoofer SW is preferably based on a structure, such as a linear resonant actuator.

[First Amplifier and Second Amplifier]

The first amplifier 40 amplifies the volume-controlled acoustic signals obtained from the first volume controller 20 and outputs the amplified acoustic signals to the Rill-range speakers SP1 and SP2. The second amplifier 50 amplifies the volume (signal level, vibration level)-controlled vibration signal obtained from the second volume controller 30 and outputs the amplified vibration signal to the subwoofer SW.

[Vibration Signal Generation Apparatus]

As shown in FIG. 1, the vibration signal generation apparatus 60 includes a band extractor (filtering unit) 100, a band selector 200, an envelope detector 300, a waveform shaper 400, and a frequency converter (vibration signal generator) 500. The functional elements 100 to 500 shown in FIG. 1 represent functional blocks implemented when the CPU of the vibration signal generation apparatus 60 performs a predetermined process in accordance with software.

Figure 2:
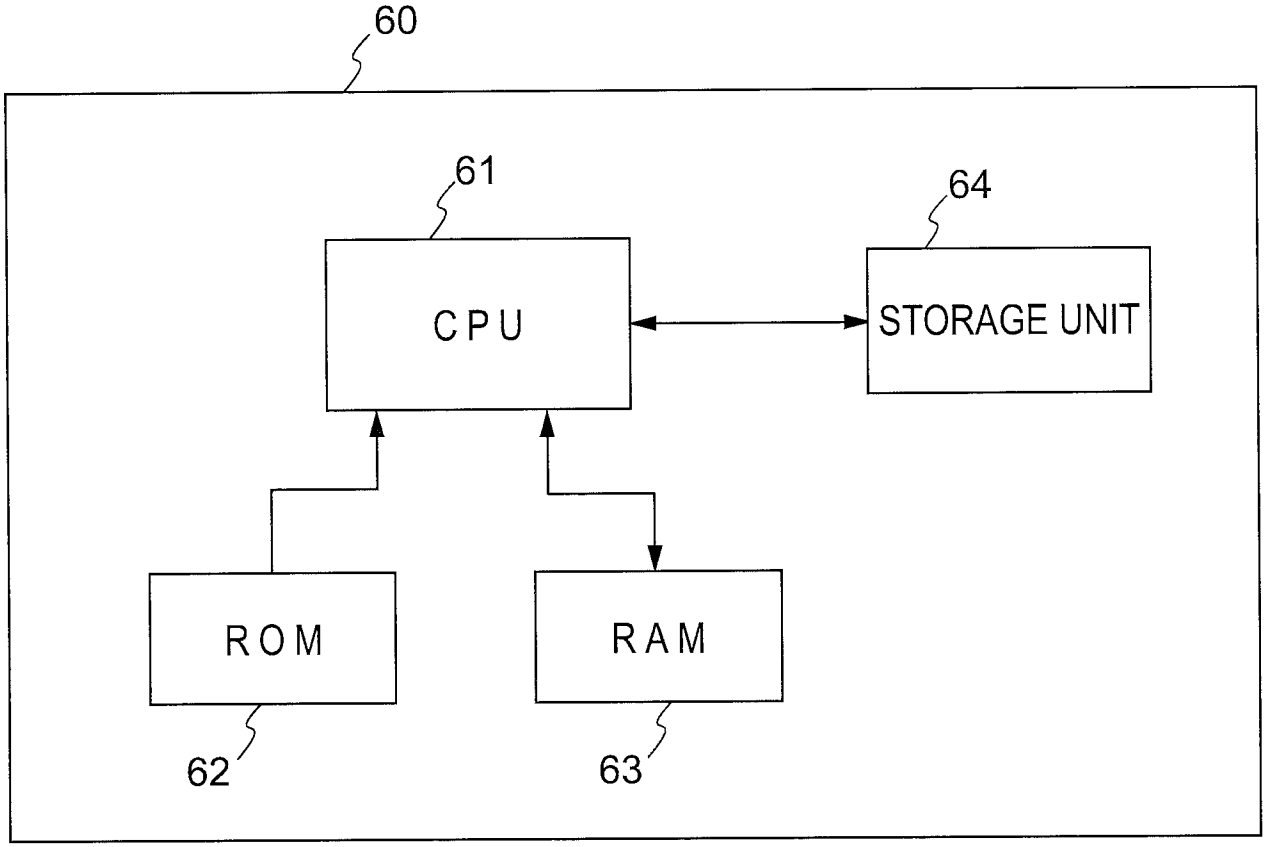
FIG. 2 is a block diagram showing a schematic hardware configuration of a vibration signal generation apparatus according to the present embodiment.

FIG. 2 is a block diagram showing a schematic hardware configuration of the vibration signal generation apparatus 60. The vibration signal generation apparatus 60 includes a CPU (central processing unit; controller) 61, a ROM (read only memory; non-transitory storage medium) 62, a RAM (random access memory) 63, and a storage unit (non-transitory storage medium) 64. The ROM 62 stores programs describing processes performed by the CPU 61 in the vibration signal generation apparatus 60. The RAM 63 is used as a work area when the CPU 61 performs a process.

The storage unit 64 is, for example, a hard disk drive (HDD), a solid state drive (SSD), or the like. The storage unit 64 stores data or the like required by the CPU 61 when performing a process. The storage unit 64 according to the present embodiment stores information indicating digitized acoustic signals generated by an A/D (analog/digital) converter (not shown), sound source information (to be discussed later), information indicating an envelope signal generated by the envelope detector 300, information indicating an amplitude-limited signal, a waveform-shaped signal, and the like generated by the waveform shaper 400, information indicating a vibration signal generated by the frequency converter 500, and the like as necessary. The vibration signal stored in the storage unit 64 is converted into analog data by a D/A (digital/analog) converter (not shown) and outputted to the second volume controller 30.

Note that a program executed by the CPU 61 when performing a process may be stored in the storage unit 64 rather than in the ROM 62. When the CPU 61 performs a process on the basis of a program stored in the ROM 62 or other unit, the functional elements 100 to 500 of the vibration signal generation apparatus 60 shown in FIG. 1 perform respective processes.

[Band Extractor]

Figure 3:
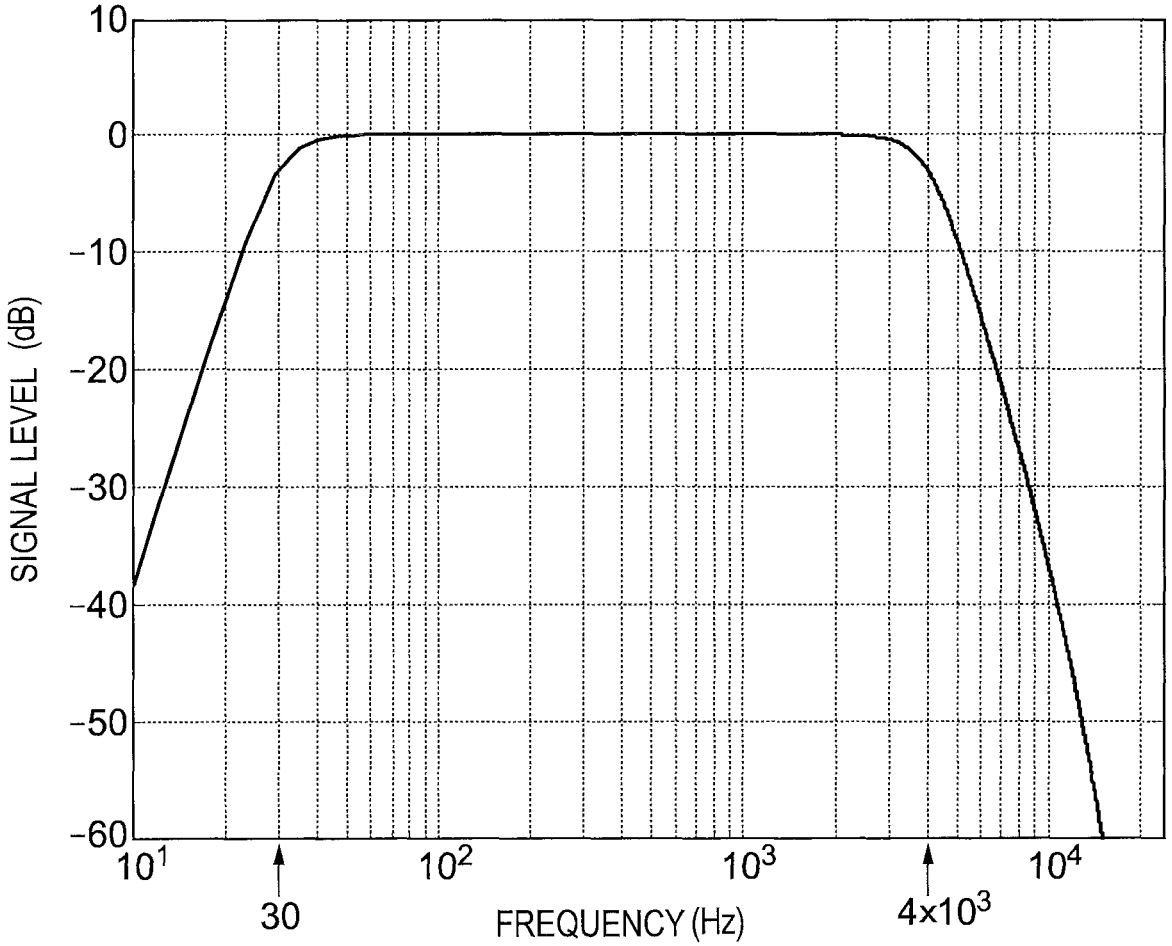
FIG. 3 is a graph showing filter characteristics of a band-pass filter used by a band extractor according to the present embodiment.

The band extractor 100 sets (makes) a predetermined band-pass filter on the basis of cutoff frequency information acquired from the band selector 200 and filters the acoustic signals acquired from the sound source playback unit 10. FIG. 3 shows frequency characteristics of an example of the band-pass filter used by the band extractor 100 in the filtering process. The band-pass filter in FIG. 3 is a quaternary Butterworth filter for which a low-band cutoff frequency of 30 Hz and a high-band cutoff frequency of 4 kHz are set. The low-band cutoff frequency and high-band cutoff frequency correspond to the cutoff frequency information acquired from the band selector 200. The band extractor 100 outputs the acoustic signal filtered (band-extracted) using the band-pass filter to the envelope detector 300.

[Band Selector]

The band selector 200 selects and determines the cutoff frequencies in accordance with characteristics or the like of the acoustic signals and outputs the cutoff frequencies to the band extractor 100 as cutoff frequency information. As described above, the cutoff frequencies determined by the band selector 200 are information consisting of the low-band cutoff frequency and high-band cutoff frequency. The band selector 200 outputs the cutoff frequency information consisting of the low-band cutoff frequency and high-band cutoff frequency to the band extractor 100.

In the cutoff frequency selection process by the band selector 200, the user may select the cutoff frequencies. For example, the user identifies the type of the acoustic signals played back by the sound source playback unit 10 and selects suitable cutoff frequencies in accordance with the type of the acoustic signals. The user may identify the type of the acoustic signals on the basis of, for example, genre number information in the ID3 tag of MP3 (MPEG-1 Audio Layer-3). Information indicating any of 100 or more genres, such as blues, jazz, pop music, rock music, vocal, and classical music, can be stored in the ID3 tag using the genre number. For this reason, the user is able to determine the type of acoustic signals on the basis of the genre number. Since the tune name, artist name, album name, and the like can also be stored in the ID3 tag, the user is also able to determine the type of acoustic signals on the basis of music information, such as the tune name or artist name. Such information indicating the type of acoustic signals will be referred to as "sound source information."

To allow the user to select signal components (frequency range) that the user wants to emphasize as a vibration, the band selector 200 may previously prepare candidate low-band and high-band cutoff frequencies and list the candidate cutoff frequencies on a display (not shown). Or, the band selector 200 may prepare multiple candidate frequency ranges each including one of combinations of low-band cutoff frequencies and high-band cutoff frequencies and list the candidate frequency ranges on a display (not shown). These cutoff frequencies need not fall within the frequency range in which the subwoofer SW is able to output vibrations.

Listing the candidate cutoff frequencies allows the user to easily and quickly select the cutoff frequencies. For example, if the acoustic signals are piano sound-based signals, the user is able to determine that the acoustic signals are piano-based music (e.g., classical music), on the basis of the genre information or the like (sound source information) in the ID3 tag. Then, the user is able to select 30 Hz as a low-band cutoff frequency suitable for piano and 4 kHz as a high-band cutoff frequency suitable for piano from the candidate cutoff frequencies being listed by the band selector 200.

Also, if the acoustic signals are cymbal-based signals, the user is able to determine that the acoustic signals are cymbal-based music on the basis genre information or the like (sound source information) in the ID3 tag. Then, the user is able to select 4 kHz as a low-band cutoff frequency suitable for cymbals and 16 kHz as a high-band cutoff frequency suitable for cymbals from the candidate cutoff frequencies being listed by the band selector 200.

As described above, the user selects the cutoff frequencies in accordance with the type (sound source information) of the acoustic signals. Thus, the band selector 200 is able to determine the cutoff frequencies most suitable for each acoustic signal and output the determined cutoff frequencies as the cutoff frequency information to the band extractor 100. Accordingly, the band extractor 100 is able to make the most suitable band-pass filter.

Also, the band selector 200 is able to determine signal components (frequency range), as cutoff frequencies, that the user wants to emphasize as vibrations and the band extractor 100 is able to make the most suitable band-pass filter. Thus, the subwoofer SW is able to output accentuated vibrations. On the other hand, if the band selector 200 does not determine the cutoff frequencies and the band extractor 100 does not filter the acoustic signals, the subwoofer SW may always generate vibrations except for a case in which the acoustic signals are silent signals. In this case, the user may have difficulty in feeing that the vibrations are accentuated and realistic, due to the steady output thereof.

In the present embodiment, the acoustic signals are filtered by extracting only signal components (frequency range) that the user wants to emphasize as vibrations. Thus, the vibration output apparatus 1 allows for outputting, as vibrations, only acoustic characteristics that the user wants to perceive as vibrations, allowing for realizing a desired acoustic environment using vibrations.

As described above, the cutoff frequencies determined by the band selector 200 are not limited to the frequency range in which the subwoofer SW is able to output vibrations. For this reason, when the subwoofer SW outputs a vibration on the basis of a vibration signal generated through processes by the envelope detector 300, waveform shaper 400, and frequency converter 500 (to be discussed later), the user is able to perceive, as a vibration, changes in the level of signal components (frequency range) that the user is not able to perceive as a vibration.

Figure 4A:
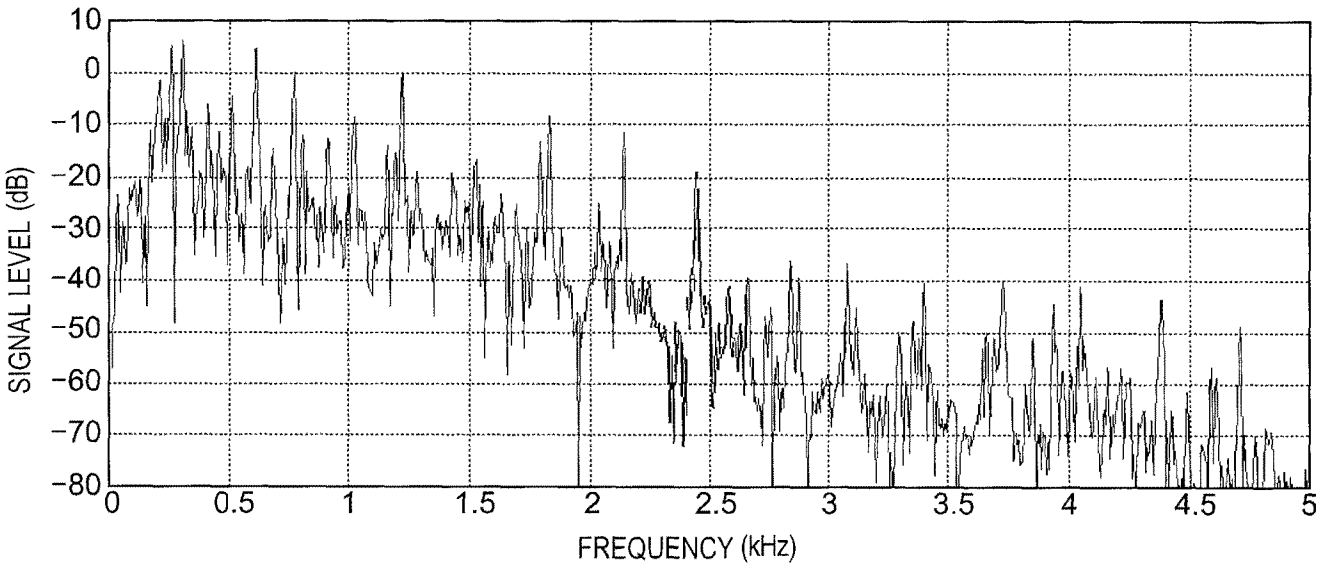
FIG. 4A is a graph showing frequency characteristics of a signal filtered by the band extractor according to the present embodiment.
Figure 4B:
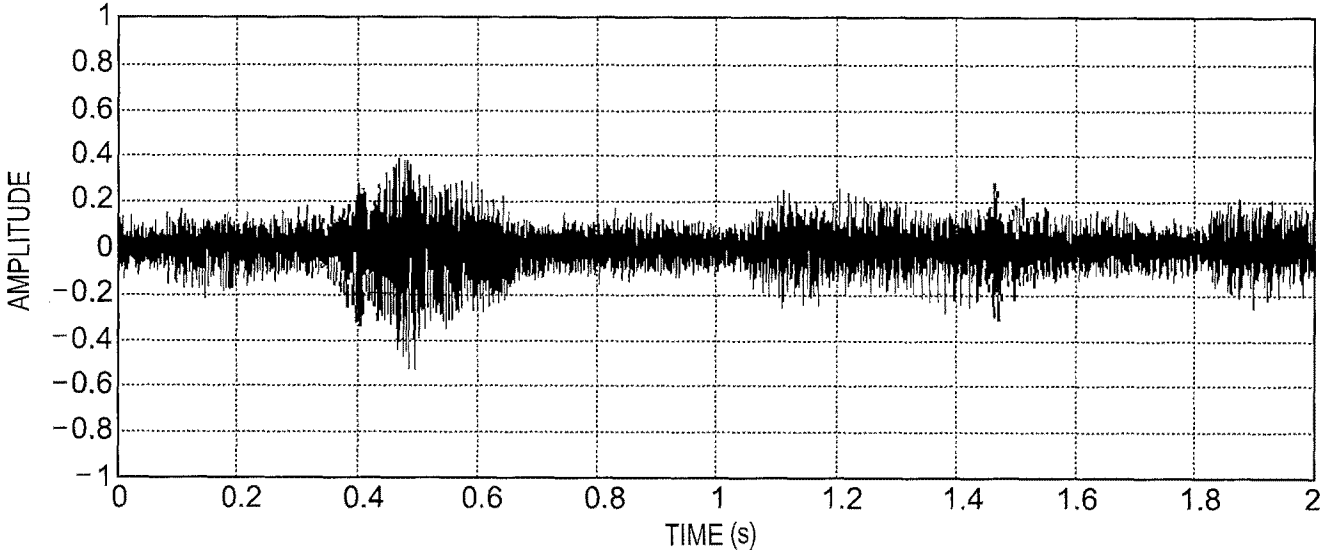
FIG. 4B is a graph showing amplitude characteristics of the signal filtered by the band extractor according to the present embodiment.

FIG. 3 shows an example of the band-pass filter set on the basis of the piano-based acoustic signals. Specifically, FIG. 3 shows filter characteristics of a quaternary Butterworth filter whose sampling frequency is 48 kHz and for which a low-band cutoff frequency of 30 Hz and a high-band cutoff frequency of 4 kHz are set. FIG. 4A shows frequency characteristics of a signal obtained by filtering the acoustic signals received from the sound source playback unit 10 using the band-pass filter shown in FIG. 3, and FIG. 4B shows amplitude characteristics of the signal.

If the band selector 200 includes means that analyzes acoustic signals, it may select and determine the most suitable cutoff frequencies by using the means to automatically analyze the music genre of the acoustic signals or the frequency of an instrumental sound or the like included in the acoustic signals.

[Envelope Detector]

Figure 5A:
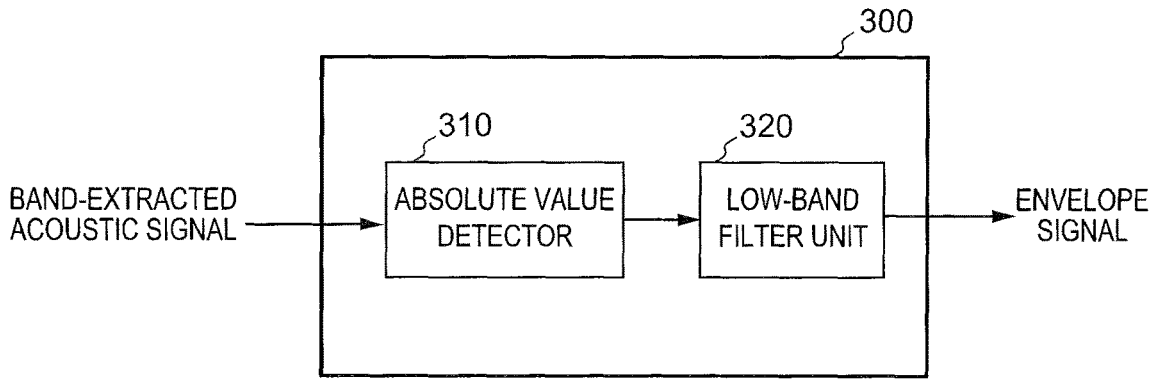
FIG. 5A is a block diagram showing a schematic configuration of an envelope detector according to the present embodiment.

As shown in FIG. 5A, the envelope detector 300 includes an absolute value detector (absolute value signal generator) 310 and a low-pass filter unit (envelope signal generator) 320. The absolute value detector 310 detects the absolute value of the band-extracted (filtered) acoustic signal generated by the band extractor 100. Since the acoustic signal inputted to the envelope detector 300 is a linear signal, the absolute value-detected signal (absolute value signal) generated by the absolute value detector 310 has positive amplitude. The absolute value detector 310 then output the absolute value-detected signal (absolute value signal) to the low-pass filter unit 320.

The low-band filter unit 320 generates (detects) an envelope signal by performing an integration process on the absolute value-detected signal obtained from the absolute value detector 310 by applying a low-pass filter to the absolute value-detected signal. The low-band filter unit 320 uses a secondary Butterworth filter as the low-pass filter.

Figure 6:
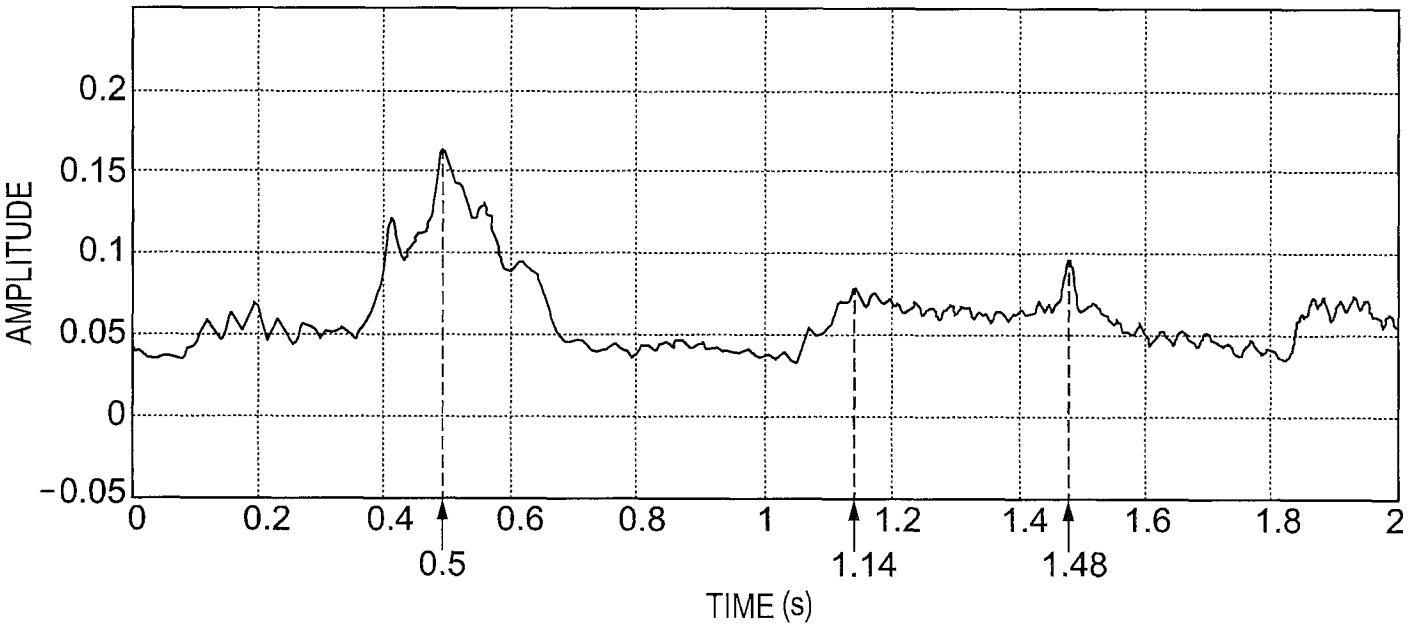
FIG. 6 is a graph showing changes in the amplitude of an envelope signal generated by a low-pass filter according to the present embodiment.

FIG. 6 shows changes in the amplitude of the envelope signal generated by the low-band filter unit 320 using the low-pass filter having a cutoff frequency of 20 Hz. The envelope signal shown in FIG. 6 is a signal generated on the basis of the acoustic signal (band-extracted acoustic signal) shown in FIG. 4B. Since the absolute value detector 310 has detected the absolute value of the acoustic signal, the envelope signal is a baseband signal including direct-current components. The low-band filter unit 320 then outputs the generated envelope signal to the waveform shaper 400.

[Waveform Shaper]

Figure 5B:
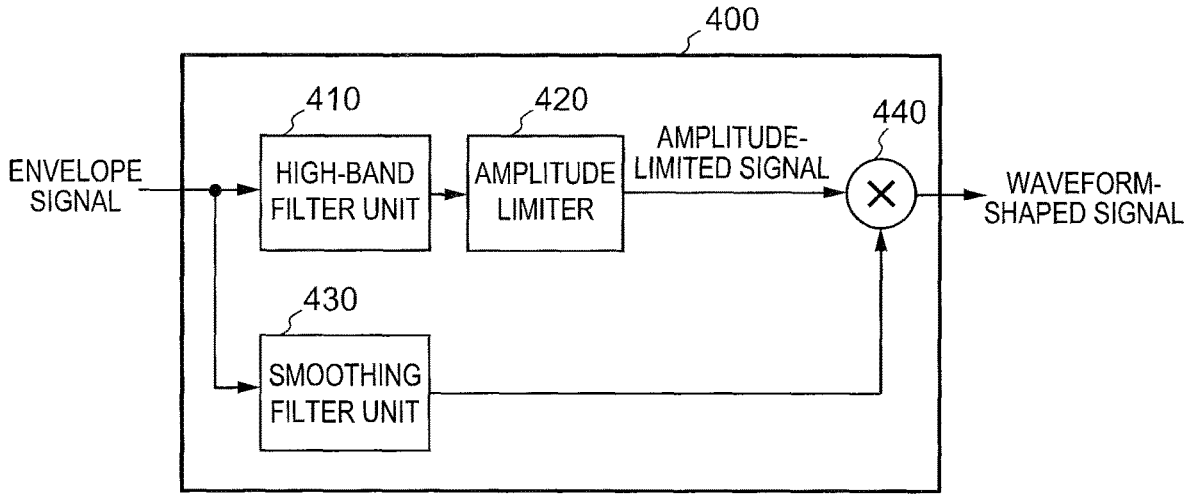
FIG. 5B is a block diagram showing a schematic configuration of a waveform shaper according to the present embodiment.

The waveform shaper 400 shapes the waveform of the envelope signal generated by the envelope detector 300. As shown in FIG. 5B, the waveform shaper 400 includes a high-pass filter unit (differentiator) 410, an amplitude limiter 420, a smoothing filter unit (smoothing unit) 430, and a multiplier 440. The high-pass filter unit 410 differentiates the envelope signal outputted to the waveform shaper 400 from the envelope detector 300 by applying a high-pass filter to the envelope signal. The high-pass filter unit 410 according to the present embodiment uses a primary Butterworth filter as an example of the high-pass filter for differentiation. The high-pass filter unit 410 then outputs the differentiated envelope signal to the amplitude limiter 420.

Figure 7A:
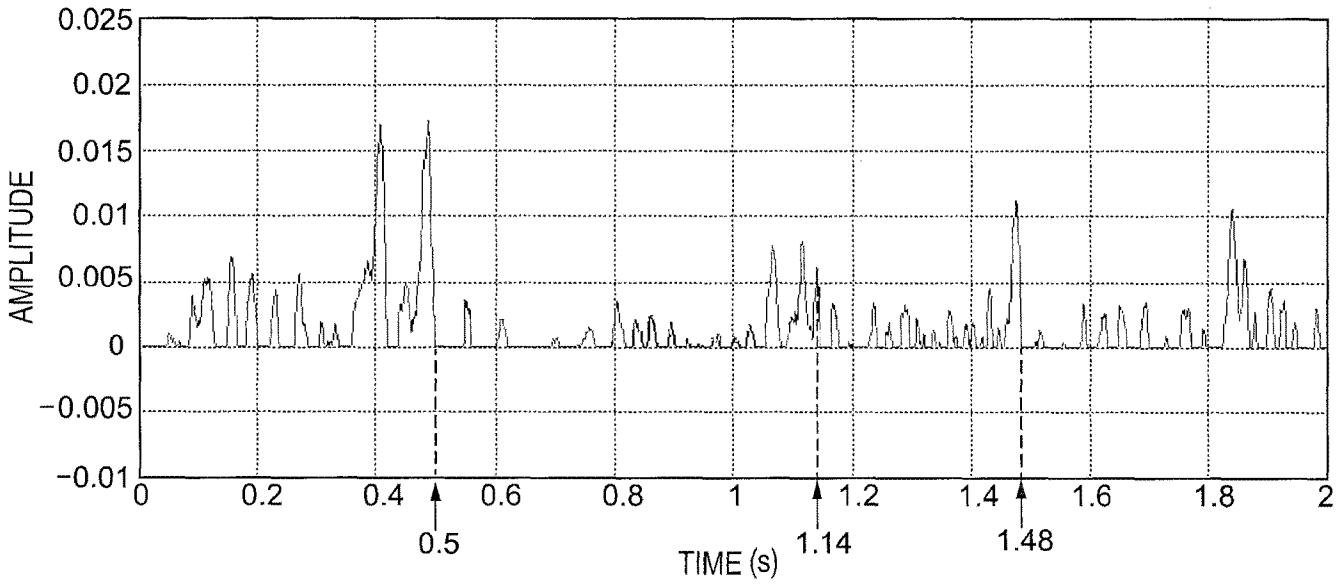
FIG. 7A is a graph showing changes in the amplitude of an amplitude-limited signal generated by a high-pass filter according to the present embodiment.

The amplitude limiter 420 limits the amplitude of the differentiated envelope signal obtained from the high-pass filter unit 410 so that the amplitude of the envelope signal becomes zero. FIG. 7A shows changes in the amplitude of the signal amplitude-limited using the primary Butterworth filter for which a cutoff frequency of 24 Hz is set (hereafter referred to as "amplitude-limited signal"). In FIG. 7A, the amplitude of the amplitude-limited signal is increased in accordance with the varying amount of rising of the amplitude of the envelope signal shown in FIG. 6.

For example, if the amplitude of the envelope signal is sharply increased around time 0.4 sec and time 0.5 sec (the amount of rising of amplitude varies greatly) as shown in FIG. 6, the amplitude of the amplitude-limited signal is greatly increased around the corresponding time 0.4 sec and time 0.5 sec in FIG. 7A. Similarly, if the amplitude of the envelope signal is increased around time 1.14 sec and time 1.48 sec in FIG. 6, the amplitude of the amplitude-limited signal is increased around the corresponding time 1.14 sec and time 1.48 sec in FIG. 7A.

If the amplitude of the envelope signal shown in FIG. 6 is sharply reduced (the amount of falling of amplitude varies greatly) or if the amplitude of the envelope signal is not changed, the amplitude of the amplitude-limited signal becomes zero at the corresponding times in FIG. 7A. The amplitude limiter 420 then outputs the amplitude-limited signal to the multiplier 440.

Only when the amplitude of the envelope signal is greatly increased by differentiating the envelope signal using the high-pass filter unit 410, the amplitude of the vibration signal is increased. The amplitude of the envelope signal is greatly increased in response to great increases in the amplitude of the acoustic signals. The vibration signal is generated on the basis of the signal obtained by differentiating and amplitude-limiting the envelope signal. Thus, the level of the vibration is further increased at the timing when the amplitude of the acoustic signals is greatly changed, resulting in accentuation of the vibration.

For example, if the amplitude of the envelope signal is not changed or is sharply reduced, the amplitude value of the differentiated envelope signal becomes zero and thus the vibration outputted from the subwoofer SW is reduced. As a result, the subwoofer SW is prevented from steadily and continuously outputting a vibration.

When the amplitude of the acoustic signals is greatly increased, a vibration having a large amplitude is generated. Subsequently, when the amplitude value of the acoustic signals is maintained or reduced, generation of a vibration is suppressed. Thus, the vibration is accentuated, and the realism of the vibration is enhanced. In particular, even if changes in the level of the acoustic signals are small, that is, if the acoustic signals have amplitude characteristics in which the amplitude value is uniform, the vibration is accentuated and the acoustic effects are improved.

Figure 7B:
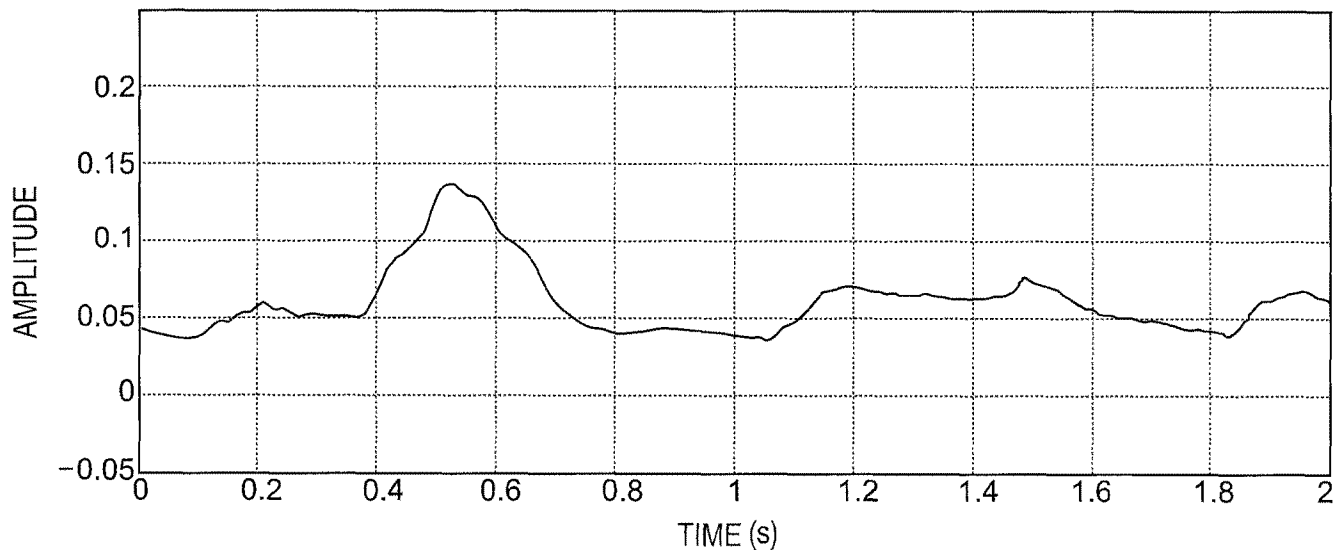
FIG. 7B is a graph showing changes in the amplitude of a smoothed envelope signal generated by a smoothing filter unit according to the present embodiment.

The smoothing filter unit 430 smooths the envelope signal generated by the envelope detector 300. Specifically, the smoothing filter unit 430 smooths changes in the amplitude of the envelope signal by applying a smoothing filter to the envelope signal. FIG. 7B shows changes in the amplitude (output waveform) of the envelope signal smoothed by the smoothing filter unit 430. The changes in the amplitude of the smoothed envelope signal shown in FIG. 7B are smoother than those of the yet-to-be-smoothed envelope signal shown in FIG. 6. Specifically, the amount of amplitude of the sharply rising and falling portions of the envelope signal in FIG. 7B is smaller than that in FIG. 6. The smoothing filter unit 430 then outputs the smoothed envelope signal to the multiplier 440.

Figure 8:
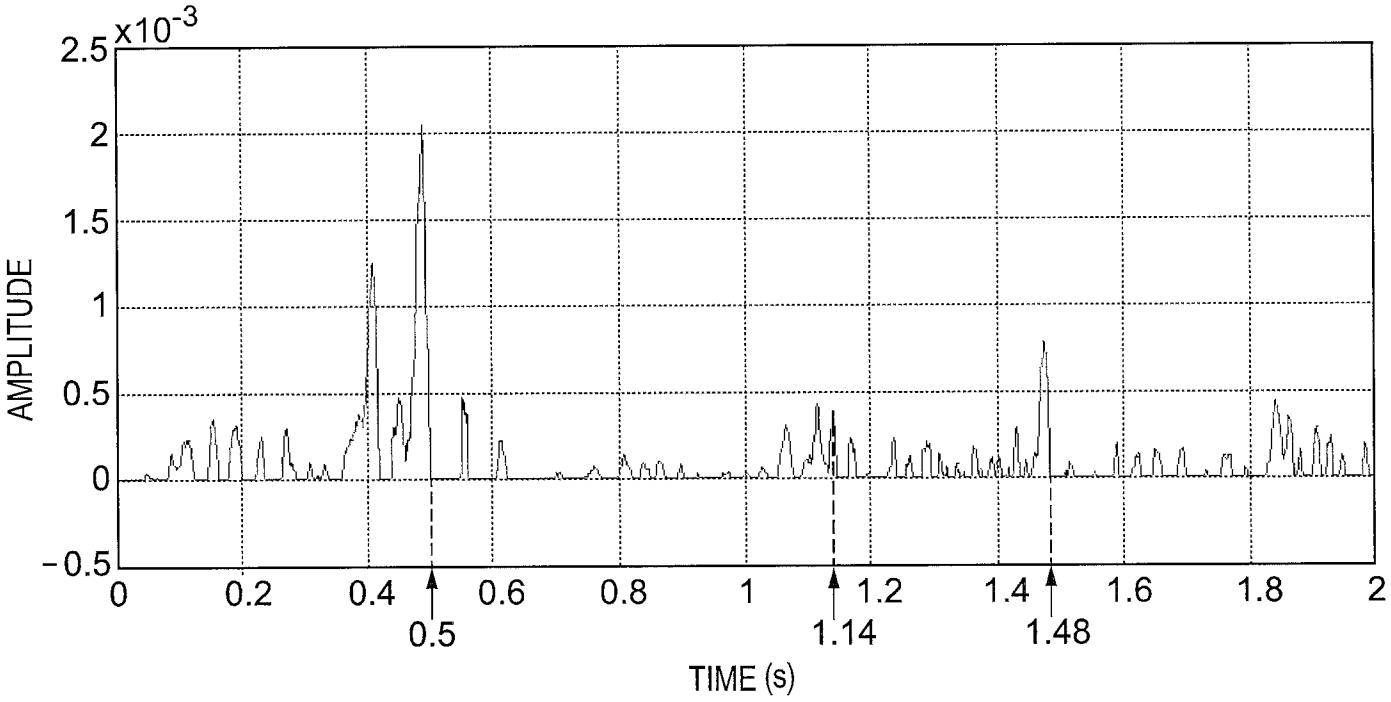
FIG. 8 is a graph showing changes in the amplitude of a waveform-shaped signal generated by a multiplier according to the present embodiment.

The multiplier 440 shapes the waveform of the amplitude-limited signal obtained from the amplitude limiter 420 by multiplying the amplitude-limited signal by the smoothed envelope signal obtained from the smoothing filter unit 430. FIG. 8 is a graph showing changes in the amplitude (output waveform) of the signal waveform-shaped by the multiplier 440 (hereafter referred to as "waveform-shaped signal").

Changes in the amplitude of the waveform-shaped signal shown in FIG. 8 are accentuated compared to those of the amplitude-limited signal shown in FIG. 7A. Also, as shown in FIGS. 7A and 8, the changes in the amplitude of the waveform-shaped signal are greater than those of the amplitude-limited signal, meaning that the dynamism of changes in the amplitude has improved.

Accordingly, generating a vibration signal on the basis of the waveform-shaped signal allows the subwoofer SW to output a vibration provided with improved dynamism. Also, since the user perceives such a vibration, the expression effects of the acoustic signals are increased. The multiplier 440 outputs the waveform-shaped signal to the frequency converter 500.

[Frequency Converter]

The frequency converter 500 generates a vibration signal on the basis of the waveform-shaped signal obtained from the waveform shaper 400. Specifically, the frequency converter 500 generates a vibration signal by performing frequency conversion by multiplying the waveform-shaped signal by a sinusoidal signal (reference signal).

Figure 9A:
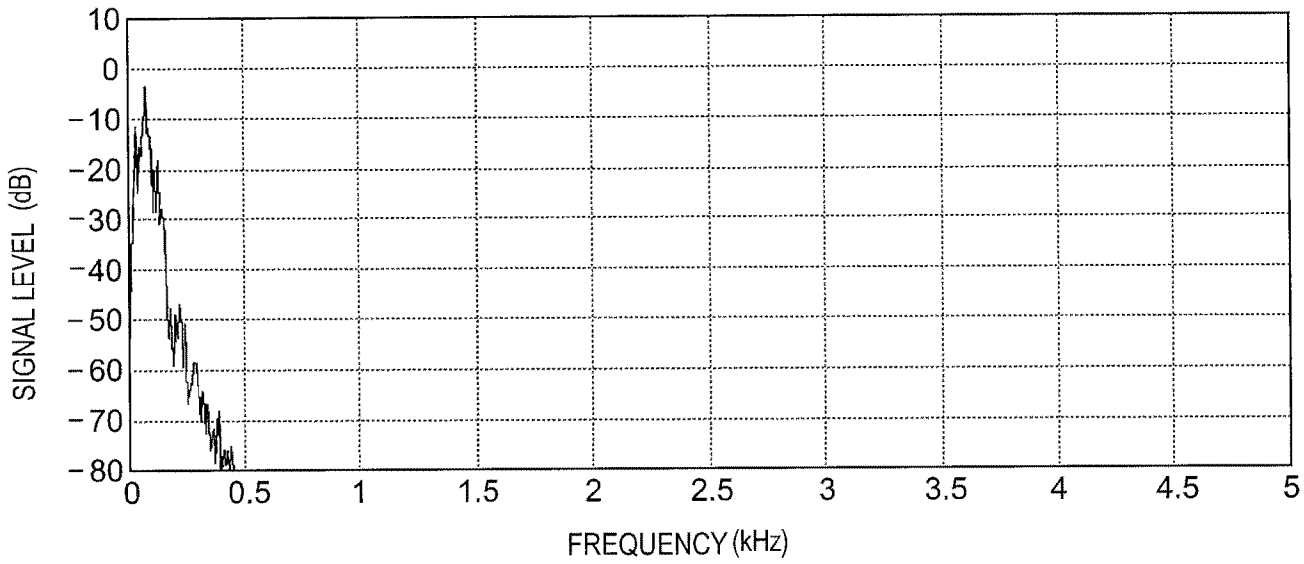
FIG. 9A is a graph showing frequency characteristics of a vibration signal generated by a frequency converter.
Figure 9B:
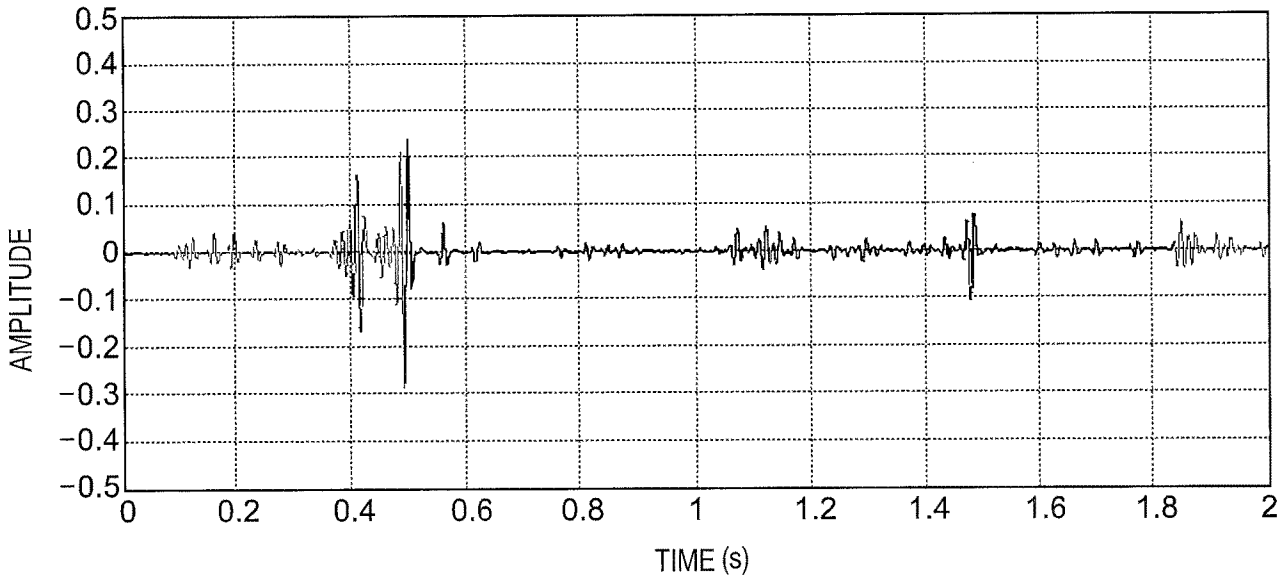
FIG. 9B is a graph showing amplitude characteristics of the vibration signal generated by the frequency converter according to the present embodiment.

As an example, FIG. 9A shows frequency characteristics of a vibration signal generated by the frequency converter 500 using a sinusoidal signal (reference signal) of 80 Hz. FIG. 9B is a graph showing amplitude characteristics of the vibration signal. The sinusoidal signal used in FIGS. 9A and 9B is a signal obtained by increasing the maximum amplitude value (signal level) of ±1 by a factor of 846 (45 dB). The frequency characteristics of the vibration signal shown in FIG. 9A and the amplitude characteristics shown in FIG. 9B are characteristics obtained by performing frequency conversion on the acoustic signal having the frequency characteristics shown in FIG. 4A and the amplitude characteristics shown in FIG. 4B.

The band-extracted acoustic signal shown in FIGS. 4A and 4B includes wide-band frequency components including mid- and high-band frequency components. On the other hand, the vibration signal shown in FIGS. 9A and 9B is a signal obtained by performing frequency conversion on the band-extracted acoustic signal so that the frequency components thereof fall within the low frequency range in which the user is able to perceive a vibration.

The reason why the frequency of the sinusoidal signal is set to 80 Hz is that the frequency range of vibrations perceivable by the Meissner's corpuscles, which are a type of tactile receptors in the skin, is about 10 to about 150 Hz and therefore an intermediate value of this frequency range is used as the frequency of the sinusoidal signal. Accordingly, when the user wants to convert the frequency of the vibration signal to a lower frequency than the frequency of the vibration signal shown in FIGS. 9A and 9B using the frequency converter 500, the user only has to set the frequency of the sinusoidal signal used for multiplication to a frequency close to 10 Hz. Also, when the user wants to convert the frequency of the vibration signal to a higher frequency than the frequency of the vibration signal shown in FIGS. 9A and 9B, the user only has to set the frequency of the sinusoidal signal used for multiplication to a frequency close to 150 Hz.

Multiple sinusoidal signals having different frequencies may be previously prepared as candidates for the sinusoidal signal used by the frequency converter 500 for multiplication and thus the user may select among the sinusoidal signals having the different frequencies in accordance with the user's preference.

The frequency converter 500 outputs the generated vibration signal to the second volume controller 30. The second volume controller 30 controls the level of the vibration signal (vibration level) and outputs the level-controlled vibration signal to the second amplifier 50. The second amplifier 50 amplifies the vibration signal acquired from the second volume controller 30 and outputs the amplified vibration signal to the subwoofer SW. The subwoofer SW outputs a vibration and a low-band sound using the vibration signal acquired from the second amplifier 50. Since the subwoofer SW is installed inside the seating portion of the seat, the user seated on the seating portion of the seat is able to perceive the vibration based on the vibration signal with the hips or thighs.

The vibration perceived by the user represents changes in the level of the band-extracted acoustic signal generated by the band extractor 100 of the vibration signal generation apparatus 60. More specifically, this vibration is a vibration obtained by converting the signal level in the frequency range in which the user wants to emphasize as a vibration in the acoustic signal, into the vibration level in a frequency range of 10 to 150 Hz perceivable as a vibration. For this reason, even if the acoustic signals outputted from the sound source playback unit 10 have a higher frequency than the upper-limit frequency (150 Hz) of the frequency range in which the user is able to perceive a vibration, the vibration signal generation apparatus 60 is able to convert the level of the acoustic signals to the vibration level in the frequency range of 10 to 150 Hz in which the user is able to perceive a vibration.

Thus, the user is able to perceive changes in the level of the acoustic signals as a vibration through the tactile sense regardless of the frequency characteristics (frequency range) of the acoustic signals outputted from the sound source playback unit 10.

The subwoofer SW outputs not only the vibration but also the low-band sound on the basis of the vibration signal generated by the vibration signal generation apparatus 60. Thus, the user is able to perceive changes in the low-band sound through the auditory sense. Specifically, the user is able not only to auditorily perceive the acoustic signals outputted from the sound source playback unit 10 as the sound outputted from full-range speakers SP1 and SP2, but also to auditorily and tactilely perceive the acoustic signals as the low-band sound and vibration outputted from the subwoofer SW. Thus, a realistic acoustic environment is realized, allowing the user to perceive three-dimensional acoustic effects auditorily and tactilely.

The vibration signal generation apparatus and computer-readable, non-transitory storage medium storing a vibration signal generation program according to the embodiment of the present invention have been described in detail using the vibration output apparatus as an example. However, the vibration signal generation apparatus and computer-readable, non-transitory storage medium storing a vibration signal generation program according to the present invention is not limited to the example described in the embodiment.

For example, in the present embodiment, the multiplier 440 of the waveform shaper 400 generates the waveform-shaped signal by multiplying the amplitude-limited signal generated by the amplitude limit unit 420 by the smoothed envelope signal generated by the smoothing filter unit 430.

However, the multiplier 440 may directly output the amplitude-limited signal to the frequency converter 500 as a waveform-shaped signal without multiplying the amplitude-limited signal by the smoothed envelope signal.

Multiplying the amplitude-limited signal by the smoothed envelope signal allows for increasing and reducing the amplitude value of the waveform-shaped signal in accordance with changes in the amplitude of the envelope signal, allowing for associating changes in the amplitude of the vibration with changes in the level of the acoustic signals. However, the amplitude-limited signal is a signal generated on the basis of the differentiated envelope signal and therefore the amplitude value of the amplitude-limited signal reflects changes in the amplitude of the envelope signal.

For this reason, even if the amplitude-limited signal is not multiplied by the smoothed envelope signal, changes in the amplitude of the amplitude-limited signal are associated with changes in the amplitude of the acoustic signals to some extent. Accordingly, even if the subwoofer SW uses the vibration signal generated using the amplitude-limited signal as a waveform-shaped signal, it is able to output a vibration having vibration characteristics corresponding to changes in the signal level of the sound outputted from the full-range speakers SP1 and SP2. Thus, the user is able to sufficiently perceive the togetherness of the vibration and sound.

In the above embodiment, the band extractor 100 performs the band extraction process on the acoustic signals. However, if the acoustic signals inputted to the vibration signal generation apparatus 60 are signals consisting of sound effects or the like obtained by previously extracting only low-band components, signals including many silent times (many amplitude-zero times), or other signals, there is less need to perform the band extraction process using the band extractor 100. In such cases, the band extractor 100 and band selector 200 may be deleted from the vibration signal generation apparatus 60 of the vibration output apparatus 1.

What is claimed is:

1. A vibration signal generation apparatus comprising:

an absolute value signal generator configured to generate an absolute value signal by detecting an absolute value of amplitude of an acoustic signal;

an envelope signal generator configured to generate an envelope signal by detecting an envelope of the absolute value signal generated by the absolute value signal generator;

a differentiator configured to differentiate the envelope signal generated by the envelope signal generator;

an amplitude limiter configured to generate an amplitude-limited signal by limiting amplitude of the envelope signal differentiated by the differentiator so that an amplitude value of the differentiated envelope signal becomes zero or greater; and a vibration signal generator configured to generate a vibration signal by multiplying the amplitude-limited signal generated by the amplitude limiter by a reference signal having a frequency that allows a human to perceive a vibration.

2. The vibration signal generation apparatus according to claim 1, further comprising a filtering unit configured to filter the acoustic signal by setting a cutoff frequency for extracting a frequency range that a user wants to emphasize as a vibration and that includes a frequency exceeding a frequency range that allows a human to perceive a vibration, wherein the absolute value signal generator generates the absolute value signal by detecting the absolute value of the amplitude of the acoustic signal filtered by the filtering unit.

3. The vibration signal generation apparatus according to claim 1, further comprising:

a smoothing unit configured to smooth the envelope signal generated by the envelope signal generator by applying a smoothing filter to changes in the amplitude of the envelope signal; and a multiplier configured to generate a waveform-shaped signal by multiplying the amplitude-limited signal generated by the amplitude limiter by the envelope signal smoothed by the smoothing unit, wherein the vibration signal generator generates the vibration signal by multiplying the waveform-shaped signal generated by the multiplier by the reference signal.

4. The vibration signal generation apparatus according to claim 1, wherein the vibration signal generator uses, as the reference signal, a sinusoidal wave having a frequency that allows a human to perceive a vibration through Meissner's corpuscles.

5. A computer-readable, non-transitory storage medium storing a vibration signal generation program executed by a vibration signal generation apparatus that generates a vibration signal for outputting a vibration from a vibration output device (SW), the vibration signal generation program causing a controller to perform:

an absolute value signal generation process of generating an absolute value signal by detecting an absolute value of amplitude of an acoustic signal;

an envelope signal generation process of generating an envelope signal by detecting an envelope of the absolute value signal generated in the absolute value signal generation process;

a differentiation process of differentiating the envelope signal generated in the envelope signal generation process;

an amplitude limiting process of generating an amplitude-limited signal by limiting amplitude of the differentiated envelope signal so that an amplitude value of the differentiated envelope signal becomes zero or greater; and a vibration signal generation process of generating a vibration signal by multiplying the amplitude-limited signal generated in the amplitude limiting process by a reference signal having a frequency that allows a human to perceive a vibration.

6. The computer-readable, non-transitory storage medium storing a vibration signal generation program according to claim 5, causing the controller to further perform a filtering process of filtering the acoustic signal by setting a cutoff frequency for extracting a frequency range that a user wants to emphasize as a vibration and that includes a frequency exceeding a frequency range that allows a human to perceive a vibration, wherein the absolute value signal generation process comprises generating the absolute value signal by detecting the absolute value of the amplitude of the acoustic signal filtered in the filtering process.

7. The computer-readable, non-transitory storage medium storing a vibration signal generation program according to claim 5, causing the controller to further perform:

a smoothing process of smoothing the envelope signal generated in the envelope signal generation process by applying a smoothing filter to changes in the amplitude of the envelope signal; and a multiplication process of generating a waveform-shaped signal by multiplying the amplitude-limited signal generated in the amplitude limiting process by the envelope signal smoothed in the smoothing process, wherein the vibration signal generation process comprises generating the vibration signal by multiplying the waveform-shaped signal generated in the multiplication process by the reference signal.

8. The computer-readable, non-transitory storage medium storing a vibration signal generation program according to claim 5, wherein in the vibration signal generation process, the controller uses, as the reference signal, a sinusoidal wave having a frequency that allows a human to perceive a vibration through Meissner's corpuscles.

* * * * *